United States Patent [19]

Lindenschmidt

[11] 4,033,806

[45] July 5, 1977

[54] METHOD OF MAKING REFRIGERATION APPARATUS ENCLOSURE STRUCTURE

[75] Inventor: Robert E. Lindenschmidt, Evansville, Ind.

[73] Assignee: Whirlpool Corporation, Benton Harbor, Mich.

[22] Filed: Aug. 4, 1975

[21] Appl. No.: 601,635

Related U.S. Application Data

[62] Division of Ser. No. 433,070, Jan. 14, 1974, Pat. No. 3,910,658.

[52] U.S. Cl. ..... 156/211; 156/268; 156/293; 220/9 G; 312/214

[51] Int. Cl.[2] ..... B32B 31/18; B65D 11/20; F25D 11/00

[58] Field of Search ..... 156/211, 254, 257, 268, 156/293; 220/9 G, 9 F; 312/214

[56] References Cited

UNITED STATES PATENTS

| | | | |
|---|---|---|---|
| 1,272,804 | 7/1918 | Hillman | 312/214 |
| 2,160,221 | 5/1939 | Masters et al. | 156/268 |
| 2,719,808 | 10/1955 | Felmendorf | 156/293 |
| 2,821,896 | 2/1958 | Kice et al. | 156/211 |
| 2,867,864 | 1/1959 | Githens | 156/211 |
| 3,234,489 | 2/1966 | Hahave | 156/211 |
| 3,420,363 | 1/1969 | Blickensderfer | 220/9 F |

FOREIGN PATENTS OR APPLICATIONS

| | | | |
|---|---|---|---|
| 1,307,811 | 2/1973 | United Kingdom | 156/268 |

*Primary Examiner*—Caleb Weston
*Attorney, Agent, or Firm*—Wegner, Stellman, McCord, Wiles & Wood

[57] ABSTRACT

A refrigeration apparatus enclosure and method of forming the same wherein an inner laminate wall is provided in an outer cabinet for providing the sheet liner and insulation portions of the refrigeration apparatus enclosure. The laminate wall is folded along lines cut through the insulation to conform to the configuration of the outer cabinet and insulation is provided for filling the resultant voids to complete the enclosure construction. The voids may be filled by foam blocks which may be cemented in place to aid in bonding the laminate wall to the outer cabinet. The rear wall of the cabinet may comprise a flat laminate wall and a divider wall may be provided within the cabinet for dividing the space therein into separate compartments. The divider wall may comprise a laminate wall and in one embodiment, comprises an extension of a laminate wall lining the cabinet.

10 Claims, 9 Drawing Figures

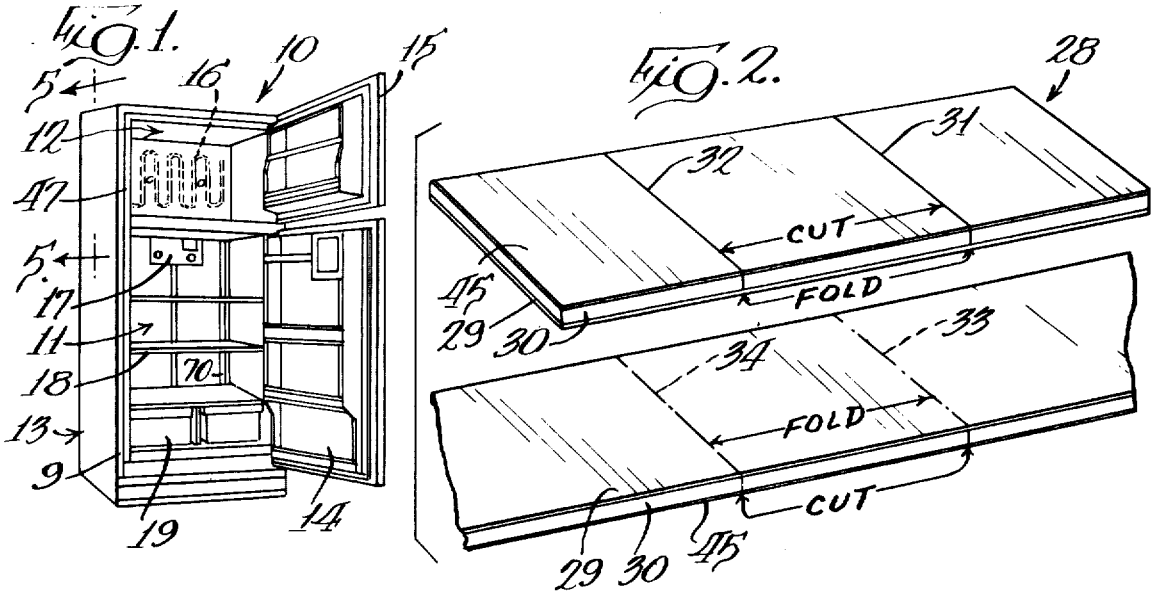
Fig. 1.
Fig. 2.
CUT
FOLD
FOLD
CUT
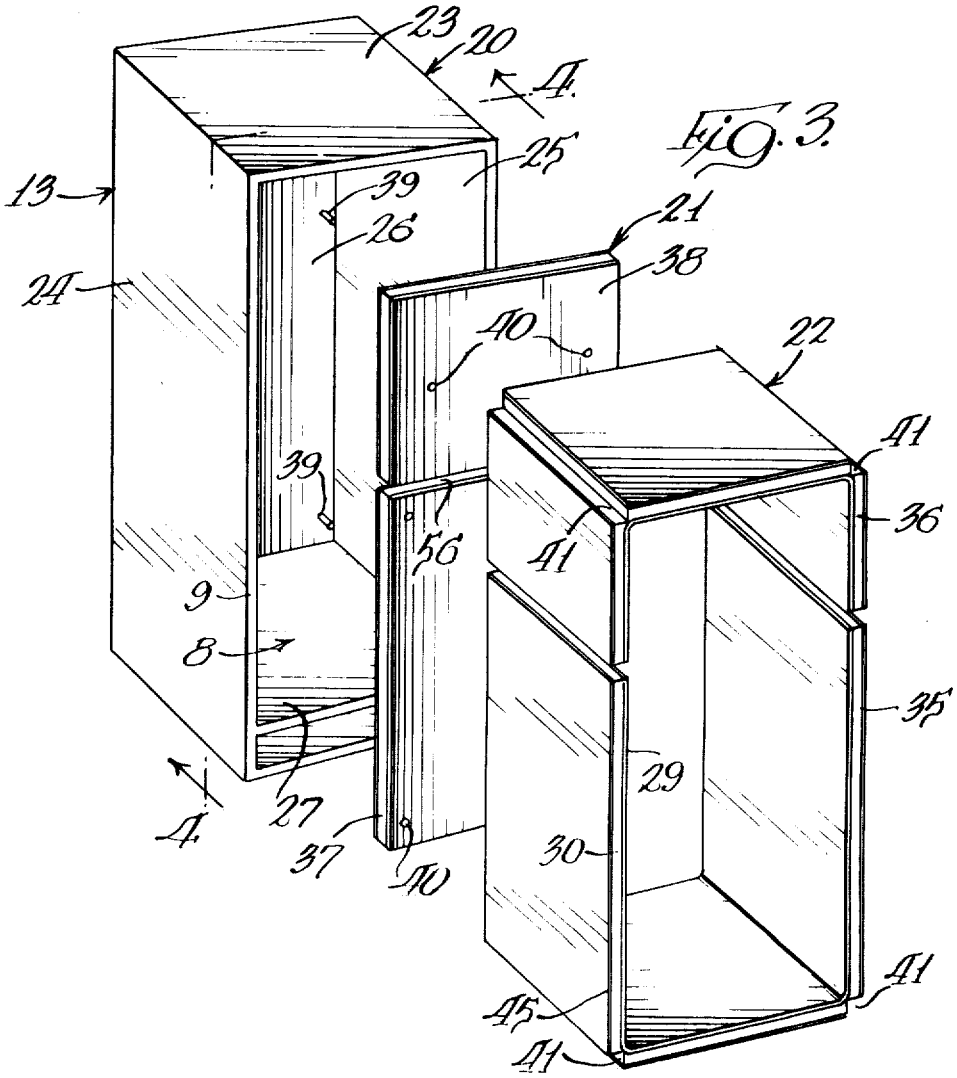
Fig. 3.

23
21
44
47
12
36
38
49
48
50
40
37
24
11
42
35
40
44
44
27
6.
42
45
44
38
41
30
36
6.

30
12
13
29
49
48
51
45
56
50
37
54
52
35
51
29
11
45
30

60
43
42
45
29
46
38
60
26
59
57
58
39
29

METHOD OF MAKING REFRIGERATION APPARATUS ENCLOSURE STRUCTURE

CROSS-REFERENCE TO RELATED APPLICATIONS

This application comprises a division of my copending application Ser. No. 433,070, filed Jan. 14, 1974 now U.S. Pat. No. 3,910,658.

BACKGROUND OF THE INVENTION

1. Field of the Invention

This invention relates to refrigeration appliances, and in particular to enclosures therefor.

2. Description of the Prior Art

In conventional refrigeration appliance cabinet constructions, an outer metal cabinet is provided having an inner liner which may conventionally be formed of plastic spaced inwardly therefrom to define a space in which is provided suitable insulation. The insulation may be in the form of fiberglass pads and in one improved form, the insulation comprises foamed-in-place insulation. One such foamed-in-place refrigeration apparatus enclosure construction is shown in U.S. Pat. No. 2,962,183, of J. C. Rill, Jr. et al. Such foamed-in-place cabinet constructions are relatively costly as they utilize separate liner elements, relatively costly preparations for the foaming operation, and costly fixtures for accurately retaining the cabinet and liner elements during the foaming operation. The liners are relatively expensive in that they require relatively costly tooling and processing steps, and the cost problems of such conventional foamed-in-place construction are aggravated where a number of different size models must be provided.

One attempted solution to this problem is that shown in U.S. Pat. No. 3,635,536 of Robert Lackey et al, wherein a portable refrigerator is shown as having a low cost cabinet utilizing a foam slab box having integral sides formed of a single sheet of foamed plastic. This patent teaches that if the foamed plastic is formed in a chilled mold process, coating of the inner and outer sides of the sheet may be omitted as the plastic is thusly formed with a thick impervious skin. In the absence of such a molding process, metal vinyl-clad sheets of extremely thin gauge may be utilized as an outer facing material. The box sides are formed from a notched slab which permits folding to the box configuration. The notches comprise cut portions on the inside of the sheet permitting the thick slab to be folded inwardly to form the box sides.

SUMMARY OF THE INVENTION

The present invention comprehends an improved refrigeration apparatus enclosure construction including an outer cabinet, an inner laminate wall within the outer cabinet defined by an inner sheet liner and outer insulation extending between the inner sheet liner and the outer cabinet, the inner liner having folded corner portions to comform the laminate to the contours of the outer cabinet, the insulation being cut through at the folded portions to define voids outwardly of the folded liner portions, and insulation means filling the voids.

The invention further comprehends a method of constructing such a refrigeration apparatus enclosure including the steps of fabricating an outer cabinet, providing a flat laminate of sheet liner and insulation, slitting the insulation along lines corresponding to the corners of the outer cabinet, folding the sheet liner at the slits with the sheet liner disposed inwardly, fitting the folded laminate within the outer cabinet with the outwardly disposed insulation confronting the inner surfaces of the cabinet, and securing the laminate to the outer cabinet.

The insulation means may define means for bonding the laminate wall to the outer cabinet and in the illustrated embodiment comprises preformed blocks of insulation material. The laminate wall may be bonded to the outer cabinet by suitable bonding means as desired.

The invention may be utilized to provide a multiple compartment enclosure including a divider wall between a pair of U-shaped laminate walls defining a pair of refrigeration chambers within the cabinet. The divider wall may further comprise a laminate wall, and in one form of the invention, comprises an integral extension of one of the U-shaped laminate walls.

The rear wall of the enclosure may comprise a laminate wall with the rear edge of the U-shaped walls butted thereto. The inner sheet liner is effectively spaced from the outer cabinet by the insulation of the laminate wall construction to provide desired insulation between the liner and outer cabinet. The divider wall may be mounted in the manner of a shelf on suitable brackets provided on the U-shaped walls.

The outer insulation of the laminate wall may include an outer vapor barrier portion. The laminate wall insulation may comprise a rigid urethane foam and the inner sheet liner may be formed selectively of plastic or sheet metal as desired. A bead of adhesive sealant may be utilized to seal the seams between the inner sheet liner portions within the enclosure.

Thus, the refrigeration apparatus enclosure of the present invention is extremely simple and economical of construction while yet providing the highly desirable features discussed above.

BRIEF DESCRIPTION OF THE DRAWING

Other features and advantages of the invention will be apparent from the following description taken in connection with the accompanying drawing wherein:

FIG. 1 is perspective view of a refrigeration apparatus having an enclosure embodying the invention;

FIG. 2 is a fragmentary perspective view of a pair of laminate sheets illustrative the process of forming the same into laminate wall elements of the enclosure construction;

FIG. 3 is an exploded perspective view illustrating the arrangement of the laminate walls in constructing the enclosure of the invention;

DESCRIPTION OF THE PREFERRED EMBODIMENTS

Figures 4, 5, 6:
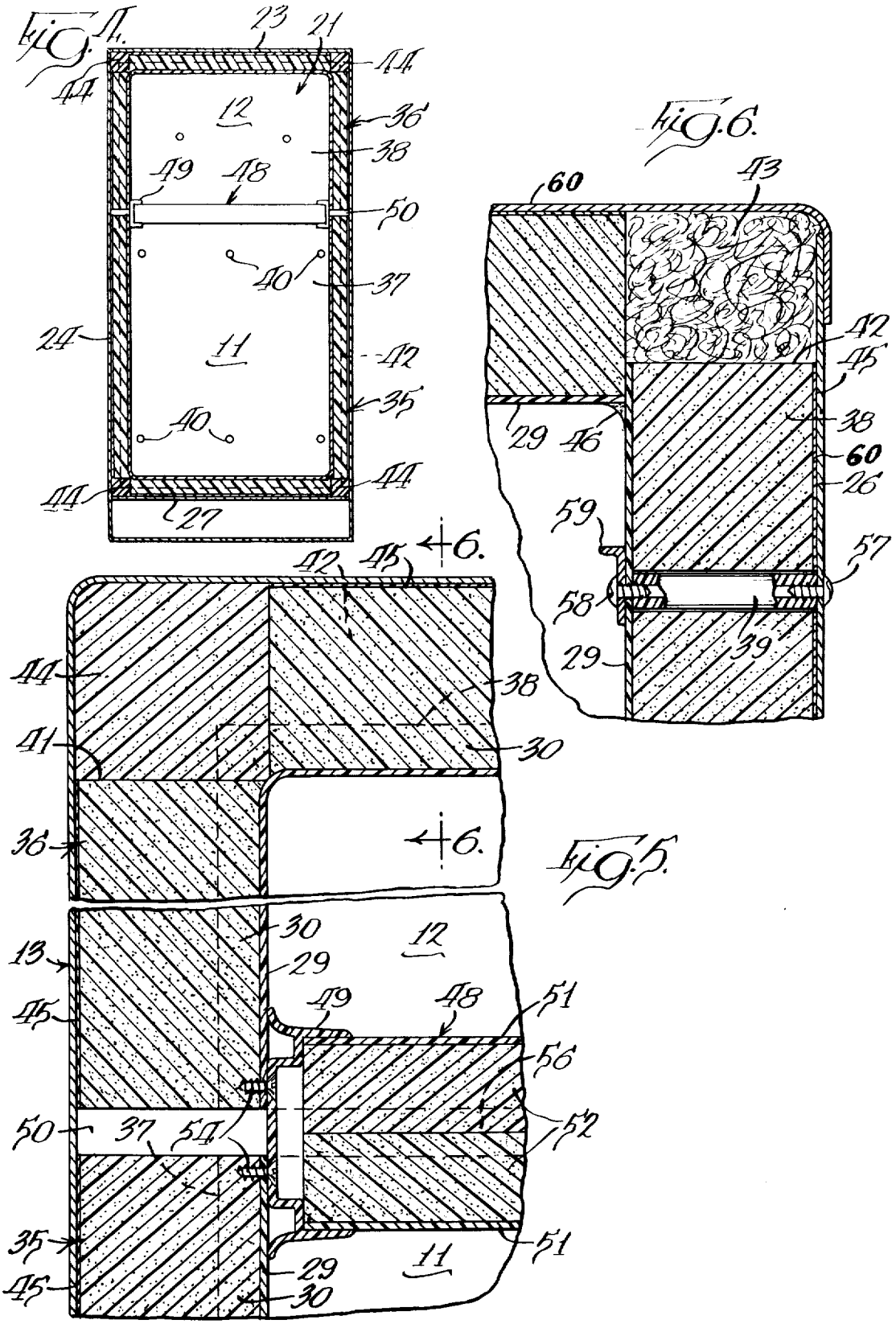
FIG. 4 is a vertical front section of the enclosure substantially along line 4—4 of FIG. 3 after assembly and having a divider wall therein dividing the space within the cabinet into a pair of refrigeration chambers.
FIG. 5 is a fragmentary enlarged vertical section taken substantially along the line 5—5 of FIG. 1.
FIG. 6 is a vertical section taken substantially along the line 6—6 of FIG. 5.

In the exemplary embodiment of the invention as shown in FIGS. 1–6 of the drawing, a refrigeration apparatus generally designated 10 illustratively comprises a refrigerator defining an above-freezing compartment 11 and a below-freezing compartment 12 defined by an insulated enclosure 13 provided with a pair of doors 14 and 15 for selectively closing chambers 11 and 12. The refrigeration apparatus may include conventional evaporator means 16, control means 17, shelves 18 supported by brackets 70, and drawer means 19. The present invention is concerned with the forming of the insulated enclosures 13 and as will be obvious to those skilled in the art, it may be utilized with other arrangements of refrigeration appliances, the refrigerator-freezer arrangement of FIGS. 1, 8 and 9 being illustrative only.

Broadly, as shown in FIG. 3, the invention comprehends providing an enclosure 13 defined by an outer cabinet generally designated 20, rear wall means generally designated 21, and wall means 22 cooperating with rear wall means 21 to provide an insulative lining of the cabinet. The outer cabinet may be formed in a conventional manner from suitable material, such as metal, to define a forwardly opening box-like constructrion having a top wall 23, left sidewall 24, right sidewall 25, rear wall 26, bottom wall 27, and a flange 9 extending around the periphery of the front opening 8. Wall means 21 and 22 cooperatively provide an inner sheet liner means and a body of insulation between the inner sheet liner means and outer cabinet to form the completed enclosure 13.

More specifically, as shown in FIG. 2, the laminate walls means 21 and 22 may be formed from a laminate sheet generally designated 28 defined by a flat sheet liner portion 29 of metal or plastic and a body of insulation 30 bonded between the sheet liner 29 and a thin plastic sheet 45 to form a laminate sandwich which may be provided in continuous length by suitable apparatus (not shown). At spaced intervals, the insulation is cut through such as at slits 31, 32, 33 and 34, permitting the sheet liner 29 to be folded along the insulation slit lines into a pair of U-shaped laminate wall elements 35 and 36 to define the laminate wall means 22. The flat laminate sheet 28 may be cut into discrete portions 37 and 38 to form the rear wall means 21, as shown in FIG. 3. As shown therein, the first laminate wall element 35 defines an upwardly opening U-shaped configuration and the second laminate wall element 36 defines a downwardly opening U-shaped configuration. The U-shaped configuration and slit insulation allow manipulation of the laminate past the flange 9 when inserting the elements into the cabinet 13 through front opening 8.

As further shown in FIG. 3, cabinet rear wall 26 is provided with a plurality of locating support posts 39 and rear laminate wall portions 37 and 38 are provided with a plurality of corresponding openings 40 for receiving the support posts both for locating the rear wall portions 37 and 38 in centered relationship to the walls 23, 24, 25 and 27 of the outer cabinet and for securing the laminate wall portions 37 and 38 to the rear wall 25 of the cabinet.

As may be seen in FIG. 3, the folded corners of the U-shaped laminate wall elements 35 and 36 define voids 41. Further, as shown in FIG. 4, as the rear laminate wall portions 37 and 38 are spaced inwardly from the cabinet walls 23, 24, 25 and 27, respectively, a peripheral void 42 extends fully about the rear laminate wall means 21. In the illustrated embodiment, void 42 is filled with fiberglass insulation 43 as shown in FIG. 6 which may be installed therein prior to the installation of the U-shaped wall elements 35 and 36. By utilizing the separate openingly confronting U-shaped elements 35 and 36, different insulation thicknesses in the insulation means of the refrigeration and freezer compartments of the enclosure 13 may be provided. Further, as seen in FIG. 4, laminate wall elements 35 and 36 may be maintained spaced apart to provide a thermal break in the resultant space 50 between the two compartments.

As shown in FIG. 5, the voids 41 may be filled with insulation 44. In the illustrated embodiment, insulation 44 comprises preformed blocks of insulation material, such as urethane foam, which may be suitably cemented in place as desired.

The laminate walls may further be bonded to the cabinet walls by suitable bonding adhesive as desired. In the illustrated embodiment, the plastic sheet 45 of the laminate walls functions as an outer vapor barrier.

As illustrated in FIG. 6, a bead of flexible adhesive sealant 46 may be laid along the seams between the sheet liner portion of the U-shaped laminate wall elements 35 and 36 and the front surface of the rear laminate wall portions 37 and 38.

Conventional breaker strip trim 47 may be assembled onto the U-shaped wall elements 35 and 36 and flange 9 as shown in FIG. 1.

As best seen in FIGS. 4 and 5, the compartments 11 and 12 are separated by a divider wall, or mullion, 48 which is retained between the sidewalls of the enclosure by means of a channel bracket 49 secured to sheet liner 29 of upper U-shaped wall element 36 and sheet liner 29 of lower U-shaped wall element 35 adjacent gap 50 so as to straddle the gap and effectively close the same along the sidewalls of the enclosure. The channel bracket 49 further extends across the rear wall portions 37 and 38 to effectively close the gap 56 between these portions. Divider wall 48, as best seen in FIG. 5, may comprise a pair of laminate walls including a sheet liner portion 51 and insulation portion 52 to define a double laminate sandwich having top and bottom metal or plastic sheet liner wall portions exposed to the chambers 12 and 11, respectively. The bracket may be secured to the liners 29 by suitable fasteners, such as screws, 54. While the divider wall 48 effectively covers the gap 56 between the rear wall portions 37 and 38 as well as the gap 50 along the sidewalls of the enclosure, the top champer 12 is effecttively thermally insulated from the lower chamber 11 by the break in the laminate wall means.

Figure 8:
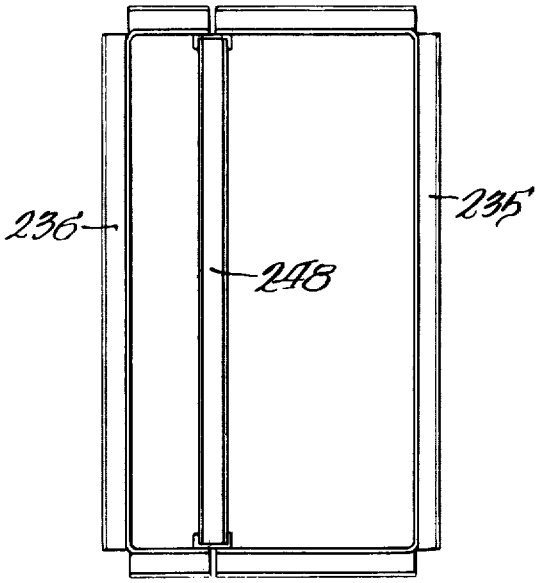
FIG. 8 is a front elevation illustrating the form of laminate wall arrangement for use in a side-by-side refrigerator-freezer.
Figure 9:
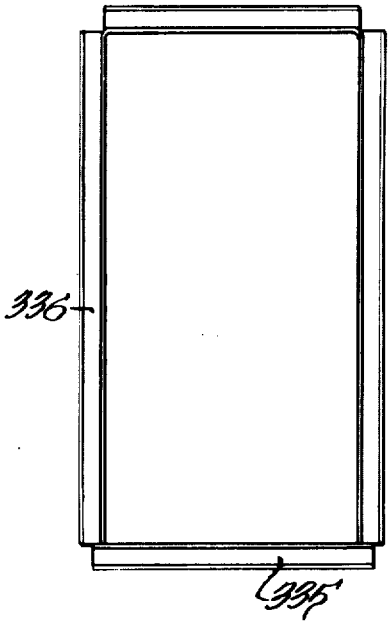
FIG. 9 is a front elevation illustrating the form of laminate wall arrangement for use in a vertical freezer.
Figure 7:
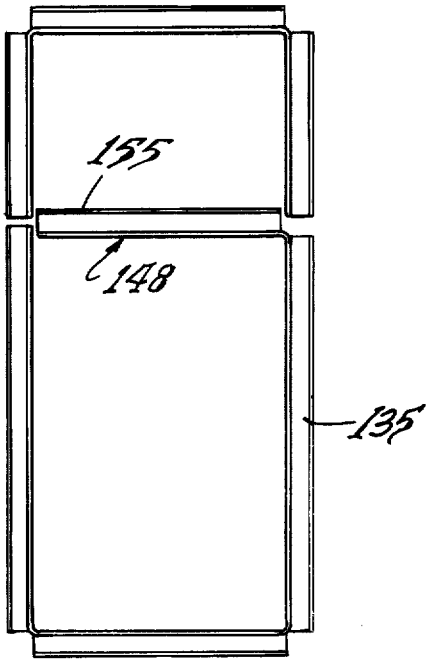
FIG. 7 is a front elevation illustrating a modified form of laminate wall arrangement for use in such a refrigeration apparatus enclosure.

In an alternative form, as shown in FIG. 7, the divider wall 148 may comprise an integral extension of the lower U-shaped laminate wall 135. A metal top plate 155 may be provided on the divider wall to cover the single thickness laminate sheet insulation. The form of the laminate structure for a side-by-side refrigerator-freezer is shown in FIG. 8. In this embodiment, the two U-shaped elements are horizontally opposed with element 235 in the above-freezing compartment and element 236 in the below-freezing compartment. Divider wall 248 separates the two compartments. For vertical freezers the form of the laminate is shown in FIG. 9, wherein U-shaped element 336 conforms to the top and sides of the cabinet and portion 335 covers the bottom of the cabinet.

The mounting posts 39 for locating and mounting the rear wall portions 37 and 38 may comprise plastic posts secured to the outer cabinet by suitable fastening means such as screws 57, and to the inner sheet liner 29 of the rear laminate wall portions by suitable means such as screws 58. The screws 58 may further serve to mount support brackets 59 or shelf brackets 70 to the sheet liner as for carrying respectively the evaporator 16 or the shelves 18 in the enclosure.

Thus, the invention comprehends an improved simplified method of constructing a refrigeration apparatus enclosure wherein a plurality of flat laminates defining an inner sheet liner and an outer insulation are provided. The laminates are folded to conform to the internal configuration of the cabinet after firstly slitting the insulation along the desired fold lines with the laminate elements being firstly cut from a continuous low cost laminate stock material. As indicated above, the stock material may include a vapor barrier as an outer portion of the insulation.

The use of the laminate construction permits adaptation of the internal construction of the enclosure to a wide variety of sizes and shapes of the refrigeration appliance enclosure. The enclosure arrangement is adapted for use with either hermetic or component hook-up refrigeration systems while yet providing the improved low cost construction of the insulated enclosure. As indicated above, adhesive means, such as adhesive 60, may be utilized to secure the laminate walls to the cabinet walls if desired.

The foregoing disclosure of specific embodiments is illustrative of the broad inventive concepts comprehended by the invention.

I claim:

1. A method of constructing a refrigeration apparatus enclosure comprising the steps of: fabricating a front opening outer cabinet having a back wall, top, bottom and side walls and defining a plurality of one-piece continuous corners; providing a flat laminate of sheet liner and insulation; cutting first wall means from said laminate; positioning said first wall means against said back wall with the sheet liner disposed interiorly; cutting second wall means from said laminate; slitting said second wall means insulation along lines corresponding to the corners of said outer cabinet; folding said second wall means sheet liner at the slits with the sheet liner disposed interiorly to define one-piece continuous corners and outer voids; fitting the folded second wall means within said outer cabinet with the insulation confronting the inner surface of the cabinet along at least two of said top, bottom and side walls and with continuous corners of said liner being inwardly respectively aligned with said cabinet continuous corners spaced therefrom by said voids; and securing said second wall means to said outer cabinet.

2. The method of constructing a refrigeration apparatus enclosure of claim 1 wherein said securing step comprises a step of adhesively bonding the insulation of said wall means to said cabinet.

3. The method of constructing a refrigeration apparatus enclosure of claim 1 further including the step of providing additional insulation material within the cabinet in said voids.

4. The method of constructing a refrigeration apparatus enclosure of claim 1 wherein said step of cutting said first wall means includes cuttting a first and a second wall portion, and said positioning step includes spacing said first wall portion along said back wall from said second wall portion.

5. The method of constructing a refrigeration apparatus enclosure of claim 1 wherein said step of cutting a second wall means includes the steps of cutting a first element and a second element, and said step of folding said second wall means comprises the steps of folding said first element to form a downwardly opening U-shaped element, and folding said second element to form an upwardly opening U-shaped element.

6. The method of constructing a refrigeration apparatus enclosure of claim 5 wherein said step of fitting the folded second wall means includes the steps of placing the first and second elements adjacent to said first wall means and spacing said first element at a distance along said side walls from said second element.

7. The method of constructing a refrigeration apparatus enclosure of claim 1 wherein said step of cutting said first wall means includes cutting a first and second wall portion, said positioning step includes spacing said first wall portion along said back wall from said second wall portion, said step of cutting a second wall means includes the steps of cutting a first element and a second element, and said fitting step includes spacing said first element above said second element in said cabinet.

8. The method of constructing a refrigeration apparatus enclosure of claim 1 wherein said step of cutting said first wall means includes cutting a first and a second wall portion, and said positioning step includes spacing said first wall portion along said back wall from said second wall portion, said step of cutting a second wall means includes the step of cutting a first element and a second element, and said step of folding said second wall means comprises the steps of folding said first element to form a downwardly opening U-shaped element, and folding said second element to form an upwardly opening U-shaped element, the vertical extent of said first element being substantially equal to the vertical extent of said first wall portion and said first element extending forwardly from said first wall portion in the fitted arrangement within the outer cabinet.

9. The method of constructing a refrigeration apparatus enclosure of claim 1 wherein said step of cutting said first wall means includes cutting a first and a second wall portion, and said positioning step includes spacing said first wall portion along said back wall from said second wall portion, said step of cutting a second wall means includes the steps of cutting a first element and a second element, and said step of folding said second wall means comprises the steps of folding said first element to form a downwardly opening U-shaped element, and folding said second element to form an upwardly opening U-shaped element, the vertical extent of said second element being substantially equal to the vertical extent of said second wall portion and said second element extending forwardly from said second wall portion in the fitted arrangement within the outer cabinet.

10. The method of constructing a refrigeration apparatus enclosure of claim 1 wherein said step of cuttinng said first wall means includes cutting a first and a second wall portion, and said positioning step includes spacing said first wall portion along said back wall from said second wall portion, said step of cutting a second wall means includes the steps of cutting a first element and a second element, and said step of folding said second wall means comprises the steps of folding said frist element to forma a downwardly opening U-shaped element, and folding said second element to form an upwardly opening U-shaped element, the vertical extent of said first element being substantially equal to the vertical extent of said first wall portion and said first element extending forwardly from said first wall portion in the fitting arrangement within the outer cabinet, and the vertical extent of said second element being substantially equal to the vertical extent of said second wall portion and said second element extending forwardly from said second wall portion in the fitted arrangement within the outer cabinet, said elements being vertically spaced to define a gap therebetween.

* * * * *